US005306225A

United States Patent [19]

Miyano et al.

[11] Patent Number: 5,306,225

[45] Date of Patent: Apr. 26, 1994

[54] DECANTER CENTRIFUGE HAVING A DISC-LIKE DIP WEIR WITH A HOLE

[75] Inventors: Keiichiro Miyano; Katsunori Nishida, both of Tokyo; Hiroshi Sano, Kanagawa, all of Japan

[73] Assignee: Tsukishima Kikai Co., Ltd., Tokyo, Japan

[21] Appl. No.: 62,030

[22] Filed: May 17, 1993

Related U.S. Application Data

[63] Continuation of Ser. No. 797,865, Nov. 26, 1991, abandoned.

[30] Foreign Application Priority Data

Nov. 27, 1990 [JP] Japan ..... 2-323864

[51] Int. Cl.[5] ..... B04B 1/20

[52] U.S. Cl. ..... 494/53

[58] Field of Search ..... 494/22, 43, 52-56, 494/67, 85; 210/380.1, 380.3, 374, 369, 372, 381, 781

[56] References Cited

U.S. PATENT DOCUMENTS

| | | | |
|---|---|---|---|
| 2,831,575 | 4/1958 | Maino | 494/53 X |
| 3,322,336 | 6/1965 | Lohse et al. . | |
| 3,447,742 | 6/1969 | Eriksson et al. | 494/53 |
| 3,784,091 | 1/1974 | Hiller | 494/27 |
| 3,934,792 | 1/1976 | High et al. | 494/54 |
| 3,955,756 | 5/1976 | Hiller | 494/54 X |
| 4,147,293 | 4/1979 | Hemfort | 494/22 |
| 4,303,192 | 12/1981 | Katsume | 494/53 X |
| 4,339,072 | 7/1982 | Hiller | 494/54 X |
| 4,378,906 | 4/1983 | Epper et al. | 494/54 |
| 4,451,247 | 5/1984 | Ostkamp et al. | 494/52 |
| 4,617,010 | 10/1986 | Epper et al. | 494/55 X |
| 4,731,182 | 3/1988 | High | 210/374 |
| 4,743,226 | 5/1988 | Day et al. | 494/53 |
| 4,915,681 | 4/1990 | Suzuki | 494/54 |

FOREIGN PATENT DOCUMENTS

| | | | |
|---|---|---|---|
| 0140672 | 5/1985 | European Pat. Off. . | |
| 176943 | 4/1986 | European Pat. Off. | 494/53 |
| 0176943 | 4/1986 | European Pat. Off. . | |
| 0682714 | 12/1969 | Fed. Rep. of Germany . | |
| 3318064 | 11/1984 | Fed. Rep. of Germany | 494/53 |
| 139167 | 10/1979 | Japan | 494/54 |
| 57-35849 | 2/1982 | Japan . | |
| 59-169550 | 9/1984 | Japan . | |
| 62-43745 | 9/1987 | Japan . | |
| 1-19941 | 4/1989 | Japan . | |
| 1329826 | 8/1987 | U.S.S.R. | 494/53 |

*Primary Examiner*—Harvey C. Hornsby
*Assistant Examiner*—Charles Cooley
*Attorney, Agent, or Firm*—Lowe, Price, LeBlanc & Becker

[57] ABSTRACT

A decanter centrifuge enables separation of solid and liquid components from a feed solution containing suspended solids by application of centrifugal force. The decanter centrifuge has at least one disc-like dip weir fixed to the outside surface of a cylindrical portion of a screw conveyor on a solid component discharge port side located away from a feed solution supply port. A predetermined distance is provided between the outermost periphery of the dip weir and the adjacent internal surface of a coaxially rotating outer shell or bowl. An overflow hole is formed adjacent the internal periphery of the disc-like dip weir to pass liquid and the outermost edge of the overflow hole is located closer to the rotational axis of the screw conveyor than the outermost edge of a liquid component discharge port. The liquid component in the incoming feed solution is thus reduced efficiently, as the feed solution passes through the centrifuge, by the separation action facilitated by the disc-like dip weir having the overflow hole.

10 Claims, 4 Drawing Sheets

DECANTER CENTRIFUGE HAVING A DISC-LIKE DIP WEIR WITH A HOLE

This application is a continuation of application Ser. No. 07/797,865 filed Nov. 26, 1991, now abandoned.

FIELD OF THE INVENTION

This invention relates to a decanter centrifuge for efficient separation of solid and liquid components from a slurry.

BACKGROUND OF THE PRIOR ART

Decanter centrifuges are sedimentation centrifuges used in clarification, dewatering and classification for the mixture of solids and liquid (slurry). Generally, the decanter centrifuge has a screw conveyor in a rotating bowl. The decanter centrifuge has a structure allowing solids, from a slurry introduced from a slurry feeding pipe inserted into the screw conveyor, to be sedimented on the inner surface of the rotating bowl due to centrifugal force. The solids are then scraped toward one end of the rotating bowl to be discharged by the screw conveyor rotating at a predetermined speed different from that of the rotating bowl. Simultaneously, separated liquid is discharged from another end of the rotating bowl by liquid pressure generated due to centrifugal force.

In conventional apparatus heretofore employed in decanter centrifuges of the above kind, dip weirs (baffles) are generally not provided. If the dip weirs are provided in such a device, efficient dewatering can not be attained. However, some decanter centrifuges provided with dip weirs have been proposed.

(a) Japanese Patent Application Laid-Open No. 59-169550 discloses a decanter centrifuge where a dip weir for cake-lay is provided and many blades are formed between the dip weir and a cake discharge port in order to obtain an orifice effect.

(b) Japanese Patent Application No. 62-43745 discloses a decanter centrifuge provided with a dip weir near a clarified liquid discharge port. Therefore, even if solid particles are attached on bubbles of separated water so as to float, the solid particles are prevented from being discharged due to the dip weir.

(c) Japanese Patent Application No. 1-19941 discloses a decanter centrifuge having a baffle disposed at the border between a conical portion and a straight shell. Then, the baffle can be rotatively adjusted to change a clearance between the baffle and a bowl so that efficient concentration can be performed.

(d) Japanese Utility Model Application Laid-Open No. 57-35849 discloses a decanter centrifuge having a baffle disposed at the border between a conical portion and a straight shell. Then, the conical portion and the straight shell can be separated clearly with the baffle so that efficient dewatering can be performed in the conical portion.

In each such conventional centrifuge, the baffle or the dip weir is provided in order to improve liquid-solids separating efficiency in the conical portion, while the straight shell has a mechanism for transporting the solids using conveyor means. Thus, in the conventional centrifuge, the straight shell does not have any mechanism for improving the efficiency for concentrating a feed solution or for efficiently dewatering a solids cake. Therefore, in the prior art, the water content in the cake depends on the degree of centrifugal force .produced in the straight shell, the length of the residence time of the feed solution in the straight shell, and the efficiency of dewatering of the feed solution in the conical portion.

SUMMARY OF THE INVENTION

It is therefore the main object of the present invention to provide a centrifuge with a straight shell with has a mechanism for improving the efficiency for dewatering a solids cake. According to the present invention, a decanter centrifuge is provided which comprises:

a rotating bowl, having a solids discharge port and a clarified liquid discharge port;

a screw conveyor, which comprises a straight shell and a conical portion and which is formed coaxially with the rotating bowl so as to be included in the rotating bowl, wherein the rotating bowl and the screw conveyor are rotated in the same direction at different speeds while a feed fluid which is to be separated into a solid component and a liquid component is introduced into a ring-shaped space formed between the rotating bowl and the screw conveyor and is continuously separated into the solid and liquid components by application of a centrifugal force whereby the solid component is discharged from the solid discharge port and the liquid component is discharged from the clarified liquid discharge port;

a slurry feeding port, provided at a wall of the straight shell of the screw conveyor and from which the feed solution is fed to the ring-shaped space;

at least one dip weir, fixed to the external periphery of the wall of the straight shell on the solid discharge port-side away from the slurry feeding port, while there is a distance between the external periphery of the dip weir and the internal periphery of the rotating bowl; and an overflow hole, which is formed at the internal periphery-side of the dip weir so that the liquid goes through the overflow hole, while the external peripheral edge of the overflow hole locates closer to the rotating axis of the screw conveyor compared with the external edge of the clarified liquid discharge port or the internal edge of a weir board provided on the clarified liquid discharge port.

Preferably, plural number of dip weirs are fixed to the external periphery of the wall of the straight shell of the screw conveyor and the dip weirs have the overflow holes respectively so that the overflow hole decreases in the length on the radius direction as the dip weir locates closer to the solid discharge port.

When plural number of dip weirs are provided, it is also preferable that the distance between the external periphery of the dip weir and the internal periphery of the rotating bowl be reduced the closer the dip weir is located to the solid discharge port.

Further, the conical portion of the screw conveyor is provided so as to connect to the solid discharge port-side end of the straight shell of the screw conveyor and if the external edge of the dip weir locates closer to the rotating axis of the screw conveyor compared with the periphery of the straight shell-side end of the conical portion, this end substantially acts as the dip weir.

The operation of the present invention is explained with reference to FIG. 1.

At least one dip weir 32, 33 is fixed to the external periphery of the wall of the straight shell 3A of the screw conveyor 3 on the solid discharge port-side away from the slurry feeding port 35 formed on the wall of the straight shell 3A. There are predetermined separations between the external peripheries of the dip weirs 32, 33 and the internal periphery of the rotating bowl 2. At least one overflow hole 32*a*, 33*a* is formed at the internal periphery of each dip weir 32, 33 so that the liquid passes therethrough. The external peripheral edges of the overflow holes 32*a*, 33*a* are located closer to the axis of the screw conveyor 3 than the internal edge of a weir board 10 provided on the clarified liquid discharge port 8.

When a slurry, e.g., a sludge, is introduced from the slurry feeding port 35 into the ring-shaped space formed between the rotating bowl 2 and the screw conveyor 3 and is sedimented toward the internal surface of the rotating bowl 2 by means of the centrifugal force, the concentration of solid matter in the sludge is higher at the internal surface thereof of the rotating bowl 2 than at the rotating axis. Force is applied by the device to the solid constituent so that it is moved toward the solid discharge port 9, e.g., with the screw conveyor 3. In this situation, the solid constituent passes as a layer through the space formed between the first dip weir 32 and the rotating bowl 2 against the resistance, whereby a consolidation force is applied to the solid layer. Accordingly, only a heavy layer, which has a relatively large solid content and a small water content, can go through the first dip weir 32. After going through the first dip weir 32, this heavy layer resides for a time between the first dip weir 32 and the screw blade 30 disposed at the solid discharge port-side of the first dip weir 32. In this resident time, a centrifugal force is applied to the heavy layer so that the separation of a light watery portion from the heavy layer is further advanced. Thus, the separated water is passed through the overflow hole 32*a* to be returned toward the slurry feeding port 35. Thus, due to the provision of the first dip weir 32 having a overflow hole 32*a*, the solid layer can be consolidated, while the watery slurry having a large water content can be returned so that only the heavy layer is moved toward the solid discharge port 9.

The same operation is carried out again for the heavy layer reaching the second dip weir 33, so that the heavy layer is further dewatered. The final liquid-solids separation is attained at a space formed between the straight shell-side peripheral end of the conical portion 3B and the rotating bowl 2. The concentrated or dewatered cake is thus continuously discharged from the solid discharge port 9.

The water content in the solid layer decreases in the successive stages of the dip weirs 32, 33, as the solid layer is transferred closer to the solid discharge port 9. The external peripheral edges of the overflow holes 32*a*, 33*a* are located closer to the rotating axis of the screw conveyor 3 then is the internal edge of the weir board 10 provided on the clarified liquid discharge port 8.

Accordingly, a watery slurry having a large water content is returned toward the clarified liquid discharge port 8. These phenomena are carried out in the field of the centrifugal force before and after the dip weirs 32, 33. Therefore, the liquid layer having a large water content is returned back toward the liquid discharge port 8 with the screw conveyor 3 as if a force is applied to separate the highly liquid portion from the dewatered solid layer.

Further objects and advantages of the present invention will be apparent from the following description, reference being had to the accompanying drawing wherein preferred embodiments of the present invention are clearly shown.

DESCRIPTION OF THE PREFERRED EMBODIMENTS

The preferred embodiment of the present invention is described below.

Figure 1:
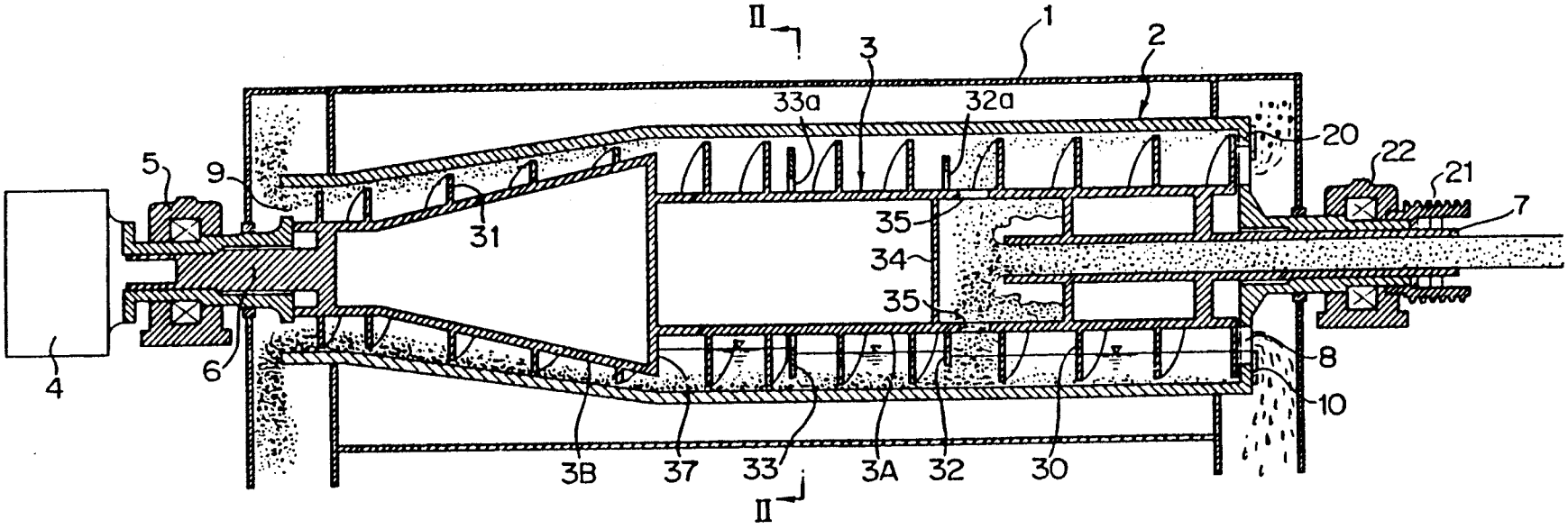
FIG. 1 is a longitudinal cross section of a decanter centrifuge related to the present invention.
Figure 2:
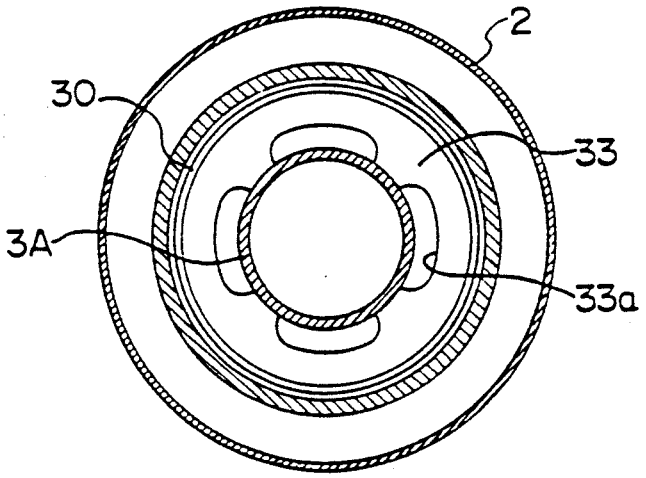
FIG. 2 is a cross-sectional view taken on line II—II of FIG. 1.

As shown in FIG. 1, the decanter centrifuge related to the present invention has a structure as stated below.

A rotating bowl 2 and a screw conveyor 3 are included in a casing 1. The rotating bowl 2 is rotated with a predetermined rotative speed by a rotational torque provided by a driving motor (not shown) through a bearing 22 by means of a pulley and a pulley belt drum 21. Another rotational torque is applied to turn the screw conveyor 3 through a gear unit 4 to a shaft end portion 6 supported by a bearing 5. Thus, the screw conveyor 3 and the rotating bowl 2 can be rotated in the same direction with a predetermined differential rotative speed.

The above rotating bowl 2 is provided with an annular side wall 20 at one end of its longitudinal direction while its another end is totally open. The mixture of liquid and solids, such as sludge, can be fed through a feed pipe 7 inserted through the center portion of the side wall 20 with some allowance. A ring-shaped clarified liquid discharge port 8 is formed at the internal periphery of the side wall 20. A ring-shaped weir board 10 is formed so as to cover the clarified liquid discharge port 8 partly in order to control the level of the clarified liquid. Thus, only the clarified liquid can be discharged from the discharge port 8. At the opposite side of the clarified liquid discharge prot 8 an annular clearance formed between the rotating bowl 2 and the screw conveyor 3 is used as a solid discharge port 9.

The screw conveyor 3 comprises a straight shell 3A and a conical portion 3B at the solid discharge end. A partition wall 34 is provided in the straight shell 3A so as to cross it substantially at its center. Due to this partition wall 34, the direction of flow of the introduced slurry can be changed to the radially outward. A slurry feeding port 35 is formed in the side wall of the straight shell 3A so that the slurry can be fed through a ring-shaped space formed between the rotating bowl 2 and the screw conveyor 3. Screw blades 30 are fixed to the external periphery of the wall of the straight shell 3A so as to encircle the straight shell 3A. Due to these screw blades 30, the solids from the slurry are moved from the slurry feeding port 35 toward the solid discharge port 9. See FIG. 1.

Figure 3:
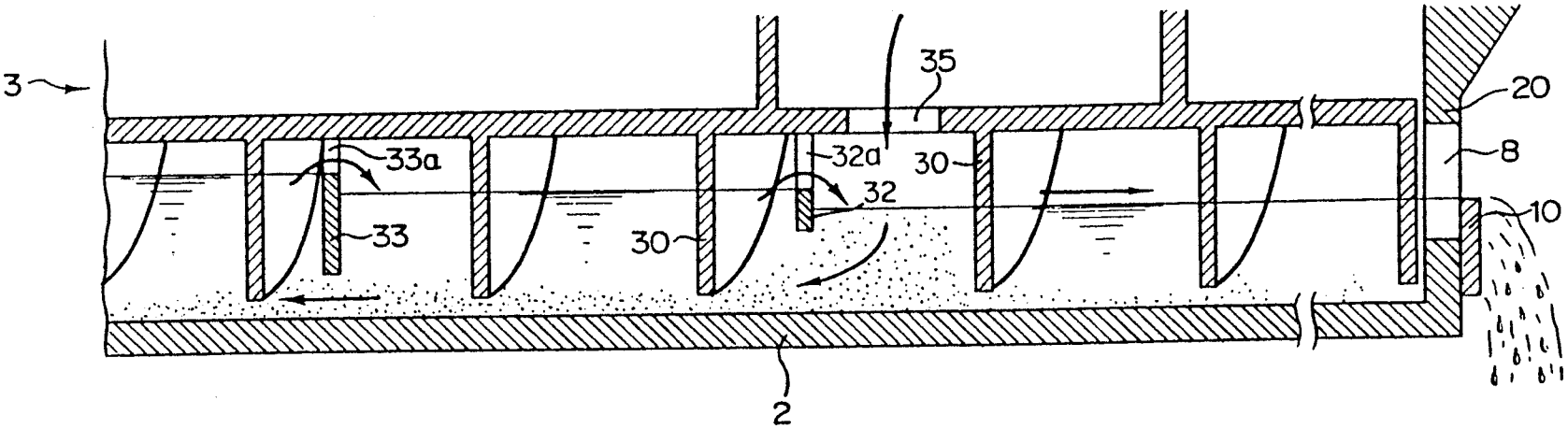
FIG. 3 is a schematic illustration of the essential part of a decanter centrifuge related to the present invention.
Figure 4:
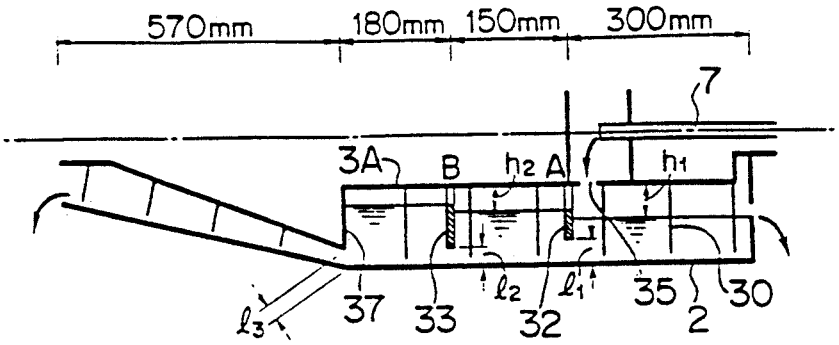
FIG. 4 is a cross section showing the structure of the essential part of a decanter centrifuge related to the present invention.

A first dip weir 32 and a second dip weir 33 are fixed to the external periphery of the wall of the straight shell 3A so as to encircle the straight shell 3A on the solid discharge port-side away from the slurry feeding port 35. As best seen in FIG. 1, each of the dip weirs 32, 33 is located within the space occupied by the screw blades 30, i.e., within the axial span of this space, to be between the axial locations of the slurry feeding port 35 and the solids discharge port 9. There is a predetermined radial separation provided between the external periphery of each of the dip weirs 32, 33 and the internal periphery of the rotating bowl 2. Overflow holes 32*a*, 33*a* are formed adjacent the internal peripheries of the dip weirs 32, 33 respectively so that the liquid from the slurry goes through the overflow holes 32*a*, 33*a*. The external peripheral edges of the overflow holes 32*a*, 33*a* are located closer to the axis of the screw conveyor 3 than is the internal edge of the weir board 10 provided on the clarified liquid discharge port 8. If the weir board 10 is not provided, the external peripheral edge of the overflow hole 32*a*, 33*a* is located closer to the axis of the screw conveyor 3 then is the external edge of the clarified liquid discharge port 8. Further, as shown in FIG. 4, the distance $l_2$ between the external edge of the second dip weir 33 and the rotating bowl 2 is shorter than the distance $l_1$ between the external edge of the first dip weir 32 and the rotating bowl 2. Then, as shown in FIG. 3, the overflow hole 33*a* of the second dip weir 33 locates closer to the rotational axis than does the overflow hole 32*a* of the first dip weir 32.

As shown in FIG. 1, the conical portion 3B has the shape of truncated cone tapered toward the solid discharge port 9. The screw blades 31 are fixed to the external periphery of the wall of the conical portion 3B so that the above-mentioned centrifugally sedimented/-consolidated solids are transformed to the form of a cake. As shown in FIG. 4, the distance $l_3$ between the straight shell-side peripheral end of the conical portion 3B and the rotating bowl 2 is smaller than the distance $l_2$. In summary: $l_3<l_2<l_1$.

Next, the operation of the liquid-solids separation with the centrifuge having the structure described above will be explained with reference to FIG. 3 where its structure is shown schematically.

The slurry, such as sludge, is introduced from the slurry feeding port 35 into the space formed between the rotating bowl 2 and the screw conveyor 3 and is sedimented toward the internal surface of the rotating bowl 2 by means of the centrifugal force. In this case, the concentration of the solid layer is higher on the internal surface-side of the rotating bowl 2 than near the rotation axis. Then, a force is applied to the solid layer, so that the solid layer can be transferred toward the solid discharge port 9, with the screw conveyor 3. The solid layer goes through the space of radial dimension "$l_1$" formed between the first dip weir 32 and the rotating bowl 2 against resistance, whereby a consolidation force is applied to the solid layer. Therefore, only a heavy layer, which has a large solid content and a small water content, can go through the first dip weir 32. After going through the first dip weir 32, this heavy layer passes between the first dip weir 32 and the screw blade 30 disposed at the solid discharge port-side of the first dip weir 32. During this passage, a centrifugal force is applied to the heavy layer so that the separation of the relatively light watery potion from the heavy and more solid layer is further advanced. Thus, the separated light portion overflows through the overflow hole 32*a* to be returned toward the slurry feeding port 35. Thus, due to the provision of the first dip weir 32 having the overflow hole 32*a*, the solid layer can be consolidated, while the slurry portion having a relatively large water content can be returned so that only the heavy layer can be moved toward the solid discharge port 9.

Next, the same operation is carried out for the heavy layer reaching at the second dip weir 33 so that the heavy layer is further dewatered. The final liquid-solids separation is attained at the space formed between the straight shell-side peripheral end of the conical portion 3B and the rotating bowl 2. The concentrated or dewatered cake is thus continuously discharged from the solid discharge port 9.

The water content in the solid layer decreases in stages in passing the dip weirs 32, 33, as the solid layer is moved closer to the solid discharge port 9. The external peripheral edge of the overflow hole 32*a*, 33*a* is located closer to the rotating axis of the screw conveyor 3 than is the internal edge of the weir board 10 provided on the clarified liquid discharge port 8. These phenomena are carried out in the field of the centrifugal force before and after the dip weirs 32, 33. Therefore, the liquid layer having a large water content is flowed back toward the liquid discharge port 8 with the screw conveyor 3 as if a force is applied to the liquid layer by the dewatered solid layer.

The separated liquid overflows via the overflow holes 32*a*, 33*a* of the dip weirs 32, 33 and the weir board 20 provided on the clarified liquid discharge port 8 and is discharged from port 8.

Figure 5:
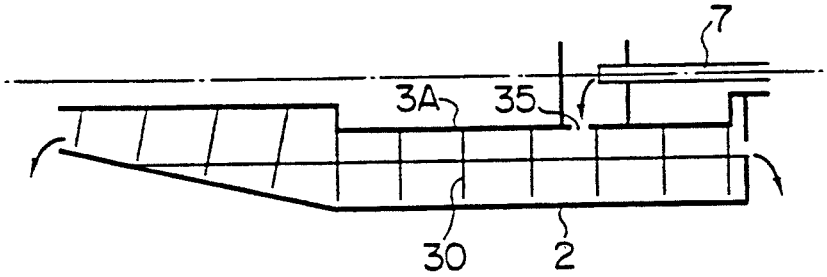
FIG. 5 (PRIOR ART)
FIGS. 5 and 6 illustrate the structures of essential parts of conventional centrifuges.
Figure 6:
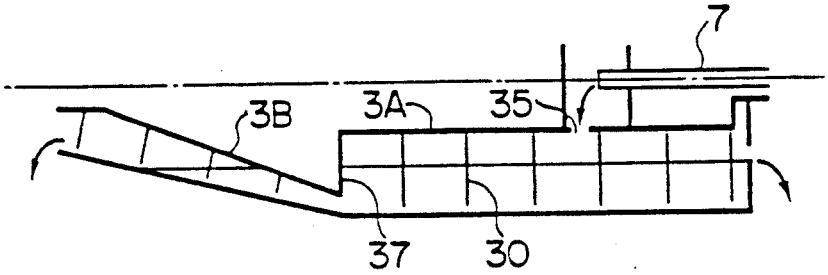
FIG. 6 (PRIOR ART)

On the other hand, in the conventional centrifuges, as shown in FIGS. 5 and 6, the above-mentioned consolidation effect felt by the solid layer, as described, can not be performed, because no dip weir is provided on the straight shell 3A.

In FIG. 1, when the level of the overflow hole 33*a* of the second dip weir 33 is the same or lower compared with the level of the solid discharge port 9, the partition wall 37 can be used as a third dip weir.

In use of the present invention, one dip weir is often enough. However, three or more dip weirs can be provided. The shape of the overflow hole can be selected optionally. Each dip weir if preferably fixed to the straight shell 3A by welding so as not to be removed. Alternatively, when the dip weir is ring-shaped and its internal periphery has a larger diameter than that of the straight shell 3A, it can be fixed to the straight shell 3A with a stay member. In this case, the overflow hole is also ring-shaped.

The benefits of the present invention are appreciated more clearly by considering examples of data based on tests.

In the following examples, mixed raw sewage sludge was used. Each applied decanter centrifuge had a bowl diameter of 460 mmO and a bowl length of 1200 mmL. The examples were performed with thee kinds of decanter centrifuges; two kinds of conventional apparatuses and one apparatus per the present invention.

First, one embodiment of the present invention is compared with the conventional apparatus.

As shown in FIG. 5, the first conventional apparatus has a dry zone in the conical portion and a dip weir or another equipment like this is not provided in the screw. As shown in FIG. 6, the second conventional apparatus has a partition wall 37 at the inlet of the conical portion 3B and a dry zone is not provided.

On the other hand, in the apparatus of the present invention, as shown in FIG. 4, two dip weirs are provided in the straight shell 3A. The partition mechanism is provided at the inlet of the conical portion 3B, as in the second conventional apparatus. The distance $l_1$ between the first dip weir 32 and the rotating bowl 2 was 50 mm. The distance $l_2$ formed between the second dip weir 33 and the rotating bowl 2 was 35 mm. The distance $l_3$ between the partition wall 37 and the rotating bowl 2 was 30 mm. On the condition that the level of the external edge of the solid discharge port is standardized, the weir levels are determined as follows. The overflow level of the external peripheral edge of the overflow hole 33*a* of the second dip weir 33 is the same as the standard, the overflow level of the external peripheral edge of the overflow hole 32*a* of the first dip weir 32 is 1.5 mm below the standard (−1.5 mm) and the level of the external edge of the clarified liquid discharge port is 3 mm below the standard (−3 mm).

With the above three kinds of the decanter centrifuges, the mixed raw sewage sludge was dewatered in each. The results obtained are shown in Table 1 below.

TABLE 1

| | Sludge Concentration (%) | Throughput ($m^2$/H) | Water Content in Cake (%) | Recovery Rate (%) |
|---|---|---|---|---|
| Conventional Apparatus 1 | 2.2–2.4 | 6 | 79–81 | 98–99 |
| | | 8 | 80–82 | |
| Conventional Apparatus 2 | | 6 | 77–79 | 98–99 |
| | | 8 | 78–80 | |
| Present Apparatus | | 6 | 75–77 | 98–99 |
| | | 8 | 76–78 | |

It is clear from Table 1 that the centrifuge of the present invention shows the following effects. Comparing with the first conventional apparatus, on the condition that the throughput is the same, the water content in the cake can be decreased by about 4% with the apparatus of the present invention. On the condition of the same water content, much sludge can be processed by more than about 30%. Then, comparing with the second conventional apparatus, on the condition that the throughput is the same, the water content in the cake can be decreased by about 2% with the apparatus of the present invention. Given the same water content, more sludge can be processed, by more than approximately 30%.

Next, for the apparatus of the present invention, if the conditions such as the number of dip weirs, provision of the overflow holes, and the overflow level of the weir are changed, the corresponding dewatering efficiency is changed as shown in Table 2 below.

The operation conditions are stated below:

| | |
|---|---|
| Sludge | The mixed raw sewage sludge |
| Sludge concentration | 2.5 to 2.6% |
| Throughput | 6 $m^2$H. |

TABLE 2

| Apparatus | Dip Weir Numbers | Dip Weir Location | Overflow Hole | Level of Weir (mm) $h_1$ | Level of Weir (mm) $h_2$ | Distance (mm) $l_1$ | Distance (mm) $l_2$ | Water Content in Cake (%) | Recovery Rate (%) |
|---|---|---|---|---|---|---|---|---|---|
| No. 1 | 1 | B | X | — | 1.5 | — | 35 | 77.9 | 98.1 |
| No. 2 | 1 | B | ○ | — | 1.5 | — | 35 | 76.2 | 98.4 |
| No. 3 | 2 | A, B | X | 1.5 | 1.5 | 50 | 35 | 76.9 | 98.2 |
| No. 4 | 2 | A, B | ○ | 1.5 | 1.5 | 50 | 35 | 74.5 | 98.7 |
| No. 5 | 2 | A, B | ○ | 0 | 0 | 50 | 35 | 77.0 | 99.0 |

Note;
A indicates the position A shown in FIG. 4.
B indicates the position B shown in FIG. 4.
X indicates that the dip weir does not have the overflow hole.
○ indicates that the dip weir has at least one overflow cavity.
$h_1$ indicates the level of the external edge of the clarified liquid discharge port.
$h_2$ indicates the level of the external edge of the overflow hole of the first dip weir.

Comparing with the centrifuge which does not have the overflow hole, the centrifuge which has the overflow hole can be used for more efficient dewatering. Thus, the water content in the cake can be decreased by about 2.0%. This effect can be obtained regardless of the number of dip weirs.

Although overflow holes are provided, when there is no difference between the levels of the weirs (see the data for Table 2) the water content in the cake is increased as compared with the case where there is level difference. Therefore, it i understood that the liquid layer with a large water content is returned toward the clarified liquid discharge port due to this difference in the locations of the overflow.

Comparing with the centrifuge provided with single dip weir, the centrifuge provided with two dip weirs can be used for more efficient dewatering.

In this disclosure, there are shown and described only the preferred embodiments of the invention, but, as aforementioned, it is to be understood that the invention is capable of use in various other combinations and environments and is capable of changes or modifications within the scope of the inventive concept as expressed herein.

What is claimed is:

1. A decanter centrifuge to separate solid and liquid components of a slurry, comprising:

an elongate cylindrical shell, provided with a solids discharge port and a clarified liquid discharge port comprising a weir board and being rotatable about a horizontal axis;

a screw conveyor, comprising a cylindrical portion and a conical portion with screw blades fixed to an external surface of the cylindrical portion and extending over an axial span of said cylindrical portion, said screw conveyer being rotatably mounted coaxially within said rotating shell and defining an annular space therebetween, said rotating shell and said screw conveyor being rotatable in the same direction at predetermined different speeds;

a slurry feeding port, formed in a side wall of said cylindrical portion of said conveyor to which said screw blades are fixed to enable a flow of said slurry into the screw conveyor to be separated into solid and liquid components in said annular space;

at least one disc-shaped dip weir, which is fixed to the external surface of said cylindrical portion of said screw conveyor said at least one dip weir extending radially outward and being disposed within the axial span of said screw blades, said at least one dip weir being located between axial locations of the solids discharge port and the slurry feeding port and sized so that there is a predetermined separation radially between an external periphery of said at least one dip weir and an adjacent internal surface of the shell; and an overflow hole formed in said at least one dip weir adjacent the screw conveyor so that said liquid component of said slurry flows through said overflow hole, a radially outermost edge of said overflow hole being disposed closer to the axis than both a radially outermost edge of said clarified liquid discharge port and a radially innermost edge of said weir board provided on said clarified liquid discharge port.

2. A decanter centrifuge according to claim 1, wherein:

a plurality of dip weirs are fixed to the external surface of said screw conveyor and said dip weirs have respective overflow holes formed so that as said dip weirs are located closer to said solids discharge port the radius of the overflow hole formed in each of said dip weirs is respectively smaller.

3. A decanter centrifuge according to claim 2, wherein:

said conical portion of said screw conveyor is formed at a solids discharge end of said cylindrical portion and said external periphery of said at least one dip weir is located closer to said axis of rotation than is an outermost periphery of an end of said conical portion connected to the cylindrical portion.

4. A decanter centrifuge according to claim 1, wherein:

a plurality of dip weirs are fixed to the external surface of said screw conveyor, and respective radial separations between the external peripheries of said dip weirs and the adjacent inner surface of the shell decrease as the respective distances of said dip weirs from said solid discharge port decrease.

5. A decanter centrifuge according to claim 4, wherein:

said conical portion of said screw conveyor is formed at a solids discharge end of said cylindrical portion and said external periphery of said at least one dip weir is located closer to said axis of rotation than is an outermost periphery of an end of said conical portion connected to the cylindrical portion.

6. A decanter centrifuge according to claim 1, wherein:

said conical portion of said screw conveyor is formed at a solids discharge end of said cylindrical portion and said external periphery of said at least one dip weir is located closer to said axis of rotation than is an outermost periphery of an end of said conical portion connected to said cylindrical portion of the screw conveyor.

7. A decanter centrifuge according to claim 1, wherein:

a plurality of radially extending dip weirs of respective predetermined radii from said axis are fixed to the external surface of the cylindrical portion of the conveyor at selected distances from the slurry feeding port, with the respective radii of said dip weirs increasing in the same order as their respective selected distances from said slurry port increase.

8. A decanter centrifuge according to claim 7, wherein:

each of said plurality of dip weirs has formed therein an overflow hole of a predetermined hole radius and having a center at a predetermined distance from said axis such that the hole radius of each overflow hole and the distance at which that overflow hole is centered both decrease as the distance of the corresponding dip weir from the slurry port increases.

9. A decanter centrifuge according to claim 8, wherein:

said conical portion of said screw conveyor is formed at a solids discharge end of said cylindrical portion and said external periphery of said at least one dip weir is located closer to said axis of rotation than is an outermost periphery of an end of said conical portion connected to the cylindrical portion.

10. A decanter centrifuge according to claim 7, wherein:

said conical portion of said screw conveyor is formed at a solids discharge end of said cylindrical portion and said external periphery of said at least one dip weir is located closer to said axis of rotation than is an outermost periphery of an end of said conical portion connected to the cylindrical portion.

* * * * *